US005487187A

United States Patent [19]

Zide et al.

[11] Patent Number: 5,487,187

[45] Date of Patent: Jan. 30, 1996

[54] UNDERARM STRAPS FOR SHOULDER PADS

[76] Inventors: Rodney M. Zide, 7 Painters Crossing; Robert M. Zide, 300 W. Fourth St., both of Williamstown, W. Va. 26187; James L. Rector, 1709 Forest Hills Dr., Vienna, W. Va. 26105

[21] Appl. No.: 210,756

[22] Filed: Mar. 22, 1994

[51] Int. Cl.[6] ..... A41D 13/00; A44B 11/25

[52] U.S. Cl. ..... 2/2; 2/908; 24/193

[58] Field of Search ..... 2/45, 2, 22, 23, 2/24, 16, 908; 24/306, 193, 197

[56] References Cited

U.S. PATENT DOCUMENTS

| | | | |
|---|---|---|---|
| 357,597 | 2/1887 | Hazelton . | |
| 386,191 | 7/1888 | Ferris . | |
| 491,123 | 2/1893 | McClure | 24/193 |
| 1,514,462 | 11/1924 | Ritter | 24/197 |
| 1,697,833 | 1/1929 | Lane | 24/197 |
| 1,887,473 | 11/1932 | Warner | 2/2 |
| 2,057,575 | 10/1936 | Houghton . | |
| 2,853,757 | 9/1958 | Rave . | |
| 3,146,461 | 9/1964 | Kavanaugh | 2/2 |
| 3,407,452 | 10/1968 | Abert et al. . | |
| 3,431,560 | 3/1969 | Austin | 2/2 |
| 3,640,273 | 2/1972 | Ray . | |
| 4,670,945 | 6/1987 | Banks . | |
| 4,878,274 | 11/1989 | Patricy . | |
| 5,029,341 | 7/1991 | Wingo, Jr. | 2/2 |
| 5,159,715 | 11/1992 | Jurga et al. | 2/2 |
| 5,187,812 | 2/1993 | Neuhalfen | 2/2 |

FOREIGN PATENT DOCUMENTS

| | | | |
|---|---|---|---|
| 56303 | 12/1891 | Germany | 24/193 |

*Primary Examiner*—Paul C. Lewis
*Attorney, Agent, or Firm*—Brady, O'Boyle & Gates

[57] ABSTRACT

Underarm straps for shoulder pads wherein a pair of non-elastic strap segments are connected between the breast plates and back plates of the shoulder pads and extend underneath the arms of the user on each side of the shoulder pads. The strap segments are adjustably connected by clamping rings which permit a quick infinite adjustment of the effective length of the underarm straps by the user pushing the strap segments forwardly to tighten the shoulder pads. One of the clamping rings is provided with a handle to facilitate the manual release of the gripping action of the clamping rings, and a releasable fastener is provided on the strap segments to hold one strap segment in a folded position over the other strap segment to cover the clamping rings after the shoulder pads have been tightened on the user.

25 Claims, 3 Drawing Sheets

UNDERARM STRAPS FOR SHOULDER PADS

BACKGROUND OF THE INVENTION

A football player's shoulder pads include a pair of padded, rigid arches or arch portions terminating in the front with a pair of breast plates, and in the rear with a pair of back plates. The breast plates are usually connected to each other by laces, and the back plates are usually connected by straps extending between the back plates and fixedly connected thereto. Some shoulder pads have been constructed as a single rigid arch through which the player's head protrudes, but such pads have comparable padded rigid arch portions terminating in front with a breast plate having right and left portions, and terminating in the rear with a back plate, having right and left portions. The present invention is applicable to both types of shoulder pad constructions.

To secure the pads on the player's shoulders, straps are provided which extend under the player's arms, along the sides of the torso, and connected between the breast plates and back plates. There can be either one or two straps for each side Of the player, as shown in U.S. Pat. No 5,159,715 and 5,187,812, and the straps are usually made of all elastic webbing, or a combination of elastic and non-elastic webbing. The ends of the straps are usually connected to the back plates by buckles riveted to the back plates, and to the breast plates by tee buckles insertable into slots provided in the breast plates. In order that the tee buckles can be inserted into their respective slots, it is necessary that the end portion of the strap, to which the tee buckle is secured, be elastic so that the end of the strap can be stretched beyond the breast plate slot to facilitate the insertion or hooking of the tee buckle into the slot.

There is a disadvantage in the use of elastic webbing to facilitate the stretching of the straps, in that the elasticity of the straps allows the shoulder pad arch to spread and be displaced on the torso when the player receives impacts on the shoulders. During the course of a season, the straps become stretched beyond their elastic limit, thereby losing their ability to hold the shoulder pads in place.

In order to overcome the disadvantages experienced with elastic straps, it has been proposed to employ non-elastic material, such as, a leather belt, attached to the back plate, and extending to the front and threaded through loops on the breast plate, an end of the belt having a conventional pin-type buckle engaging selective holes provided in the belt. While this arrangement overcomes the above-noted problem experienced with elastic straps, besides being expensive, the pin-type buckle provides only finite, stepped adjustment for belt or strap lengths.

To overcome the disadvantages experienced with the above-noted elastic, and non-elastic straps, after considerable research and experimentation, the underarm straps of the present invention have been devised.

SUMMARY OF THE INVENTION

Each underarm strap of the present invention comprises, essentially, a pair of strap segments of non-elastic strap material, for example, non-elastic webbing material. The end of the first strap segment is buckled to a back plate of the shoulder pad, and the other end of the first strap segment may be threaded through a kidney pad, where applicable, and provided with a loop through which a pair of superimposed clamping rings extend. A first component of a fastener is provided on the first strap substantially intermediate the ends thereof. The first end of the second strap segment is drawn upwardly through both clamping rings and then downwardly over the rim of the upper or outer clamping ring and under the rim of the lower or inner ring. The first end of the second strap segment is provided with a second component of a fastener adapted to cooperate with the first component of the fastener on the first strap segment, to thereby detachably interconnect the first and second strap segments. The opposite or second end of the second strap segment is provided with a tee buckle, or similar connector, adapted to be detachably connected to the breast plate of the shoulder pad.

With the tee buckle connected to the breast plates, the shoulder pads are tightened by the user grasping the first ends of the second strap segment on each side of the shoulder pads and pushing forwardly to thus tighten the breast plate portions and back plate portions against the torso of the user to the desired degree. The first ends of the second strap segment are then folded back to cover the clamping rings and then fastened to the first strap segments.

To loosen the straps, the first ends of the second strap segments are disconnected from the respective first strap segments and unfolded forwardly to uncover the clamping rings. The upper or outer ring is provided with a handle portion facing forwardly toward the breast plate to facilitate the easy and quick release of the second strap segment by the wearer, using the same hand used for tightening the straps, pulling outwardly on the upper clamping ring away from the straps and away from the side of the torso.

By the construction and arrangement of the underarm straps of the present invention, the use of non-elastic webbing prevents the spread of the back plates and breast plates of the shoulder pad upon impact on the arches thereof. The strap arrangement provides an infinite adjustment of the length of the straps for tightening the shoulder pads on the user, no matter what his size, wherein the user grasps the first ends of the second straps on each side of the shoulder pads and pushes forwardly with a natural forward motion where major arm strength is utilized, rather than tightening by pulling the straps to the rear where arm strength is relatively week. The shoulder pads can thus easily be put on, tightened to a selective tightness, loosened and removed by the wearer without any assistance.

DESCRIPTION OF THE PREFERRED EMBODIMENT

Figure 1:
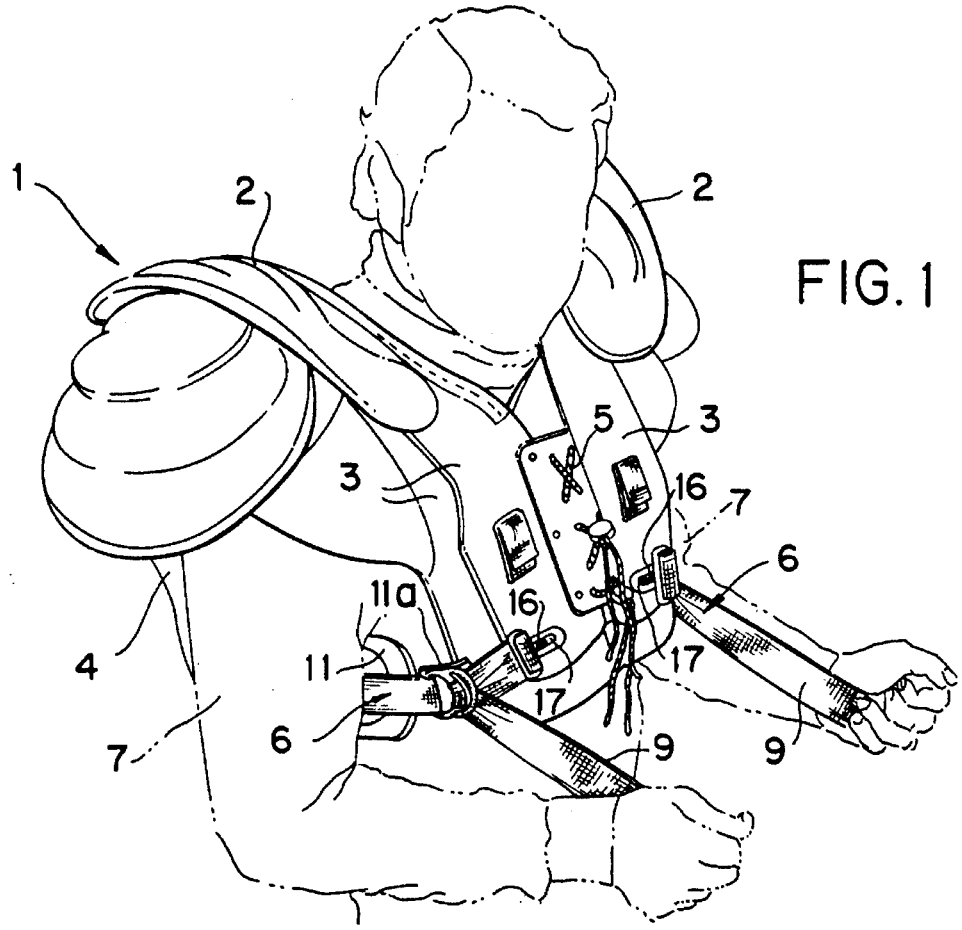
FIG. 1 is a perspective view of the underarm straps of the present invention on shoulder pads illustrating the forward arm motion shortening of the straps to tighten the pads on the user.
Figure 2:
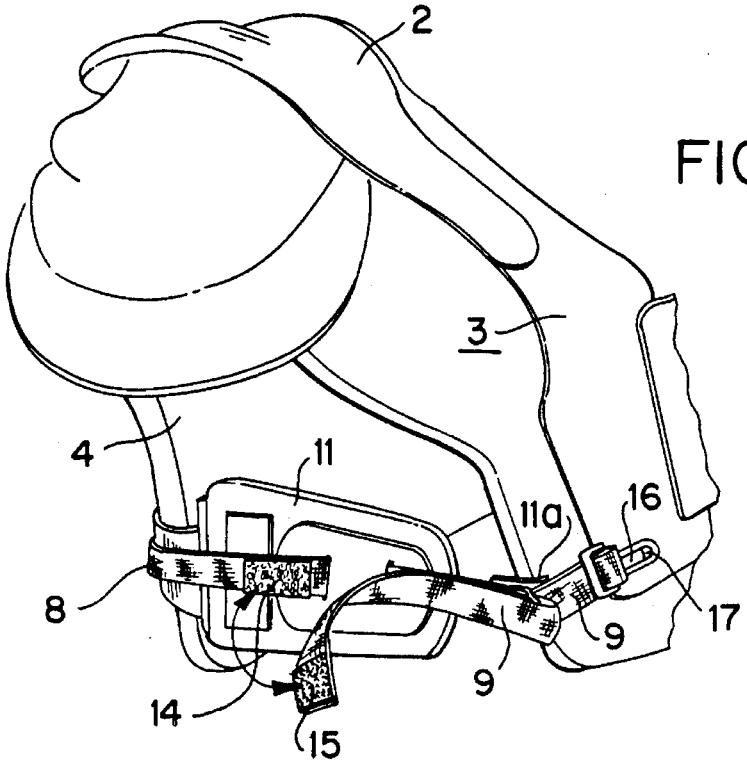
FIG. 2 is a fragmentary perspective view of a shoulder pad showing one of the underarm straps wherein one of the straps segments is detached from the other strap segment.

Referring to the drawings, and more particularly to FIGS. 1 and 2, a football player's shoulder pads 1 include a pair of padded, rigid arches 2 terminating in the front with a pair of breast plates 3, and in the rear with a pair of back plates 4. The breast plates 3 are connected to each other by laces 5, while the back plates 4 are connected to each other by transversely extending straps, not shown, fixedly connected thereto.

To secure the shoulder pads 1 on the player's shoulders, the straps 6 of the present invention are provided which extend under the player's arms 7, along the sides of the torso and connected between the lower end portions of breast plates 3 and back plates 4.

Figure 3:
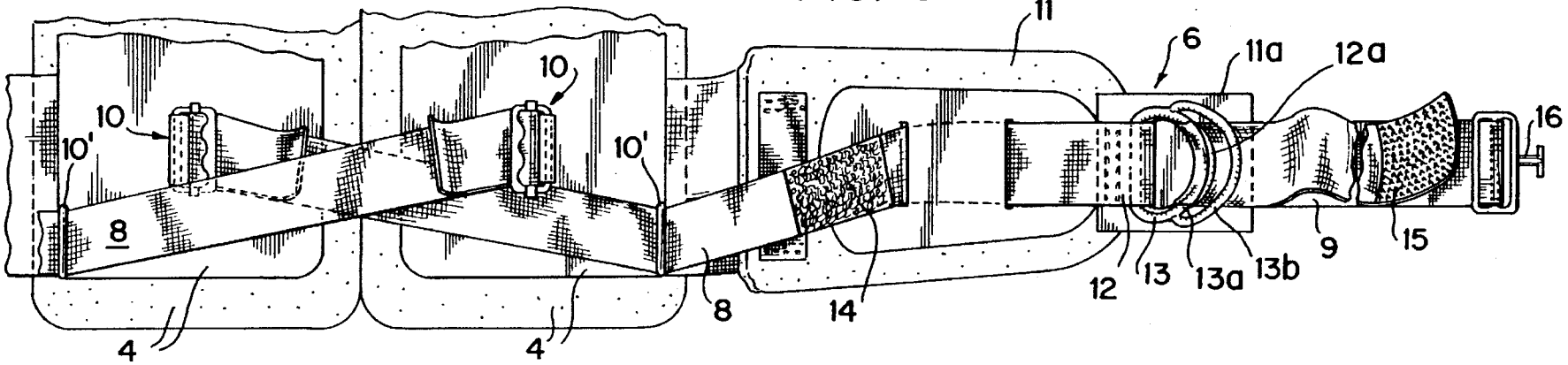
FIG. 3 is a plan view showing the length of one of the underarm straps including a pair of strap segments connected to a back plate and a kidney pad.
Figure 4:
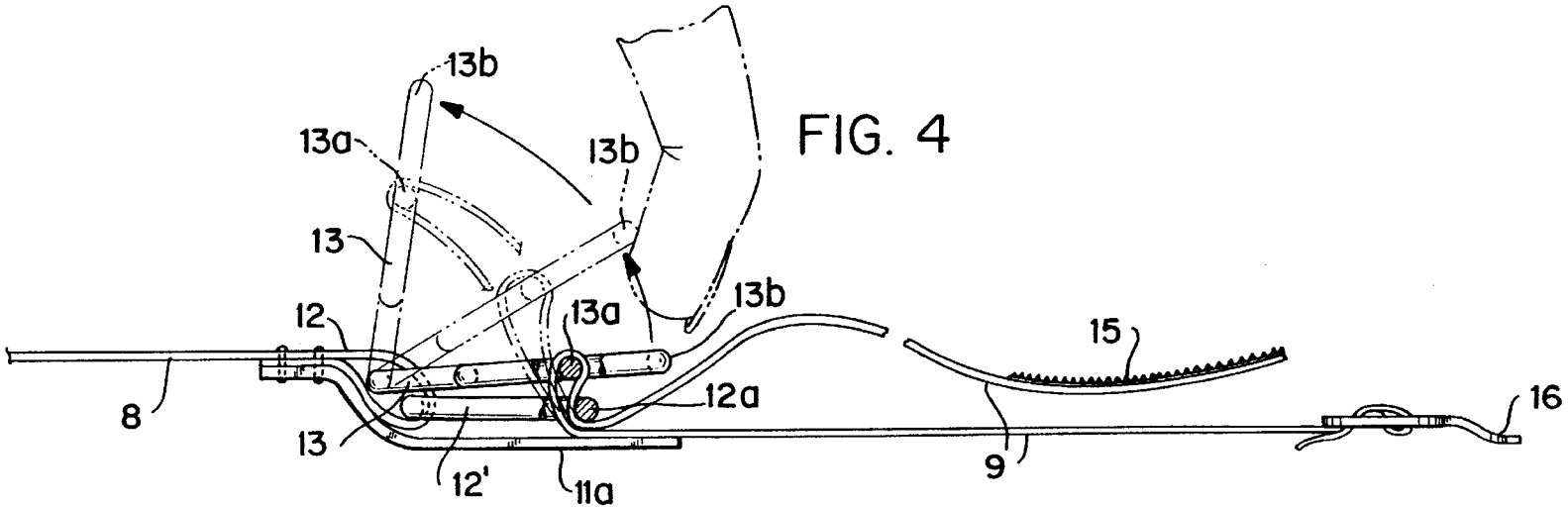
FIG. 4 is an enlarged bottom view of a fragmentary portion of one of the underarm straps, as shown in FIG. 3, and showing, in phantom, the manipulation of the handle portion of the upper clamping ring to release the locking ring from one of the strap segments.

As will be seen in FIGS. 3 and 4, each underarm strap 6 of the present invention comprises, a pair of strap segments 8 and 9 of non-elastic strap material, such as webbing. The end of strap segment 8 is buckled as at 10 to one of the back plates 4, and the other end of the strap segment 8 is threaded through a guide member 10' on the back plate, inserted through a kidney pad 11, where applicable,and provided with a loop 12 through which a pair of superimposed clamping rings 12' and 13 extend. A protective pad 11*a* is provided under the clamping rings 12' and 13 to prevent them from injuring the wearer, and is connected to the end of strap segment 8, beneath loop 12, preferably with the same stitching through the strap that forms loop 12. A fastener component 14, such as a looped fabric, is provided on the strap segment 8 substantially intermediate the ends thereof.

One end of strap segment 9 is drawn upwardly through both clamping rings 12' and 13 and downwardly over the rim 13*a* of the upper or outer clamping ring 13 and under the rim 12*a* of the lower or inner ring 12', whereby the strap segment 9 is clamped, cinched, or gripped between the curved ring rims 12*a* and 13*a*. By use of curved ring rims 12*a* and 13*a* strap tension tends to wedge the strap toward the center of the curved ring rims thereby enhancing cinch action on strap segment 9 as the rings 12' and 13 cooperate. Lower ring 12' is D-shaped. The upper ring 13 is a double D-shaped ring, and is provided with an integral loop portion 13*b* extending radially outwardly from the rim 13*a* to thereby provide a convenient smooth handle for releasing the clamping rings 12' and 13 from the strap gripping position, as shown in FIG. 4. To release the clamping rings, the user places a finger under the handle loop portion 13*b* and pivots ring 13 in loop 12 outwardly, away from the torso and straps, as shown in phantom lines in FIG. 4. This is a very easy and convenient movement for the user to perform by himself to release strap segment 9 and provide sufficient slack so the shoulder pads can be removed.

The end of the strap segment 9 is provided with a fastener component 15, such as a hook fabric, which cooperates with the loop fabric 14 on strap segment 8, whereby the strap segments are detachably interconnected, as will be seen in FIG. 2, in which position strap segment 9 forms an outer protective cover for clamping rings 12' and 13.

To complete the structure of the underarm strap, a tee buckle 16 is secured to the other end of strap segment 9 and insertable into a slot 17 provided in the breast plate 3, as shown in FIGS. 1 and 2. It is to be understood that another type of buckle can be used for connecting strap segment 9 to the breast plate.

In use, after putting the shoulder pads on, with the tee buckles 16 inserted into their respective slots 17, and the clamping rings 12' and 13 being in the released position, as shown in phantom in FIG. 4, the player grasps the free ends of the strap segments 9, as shown in FIG. 1, and pushes forwardly using the natural major arm strength humans have in this position, to thereby shorten the effective length of the underarm straps 6, whereby the breast plates 3, back plates 4 and kidney pads 11 are drawn toward the player's body to the snugness selected by the player, to thereby prevent the spread of the breast plates 3 and back plates 4 when a blow is imparted to the shoulder pad arches 2. During the pushing forward of the strap segment 9, to shorten the same, the strap segment is gripped between the rims 12*a* and 13*a* of the clamping rings 12' and 13. After the straps 6 are sufficiently tightened, the segments 9 are folded back on themselves to cover the rings 12' and 13, and the fastening components 14 and 15 are interconnected, as shown in FIG. 2.

Figure 5:
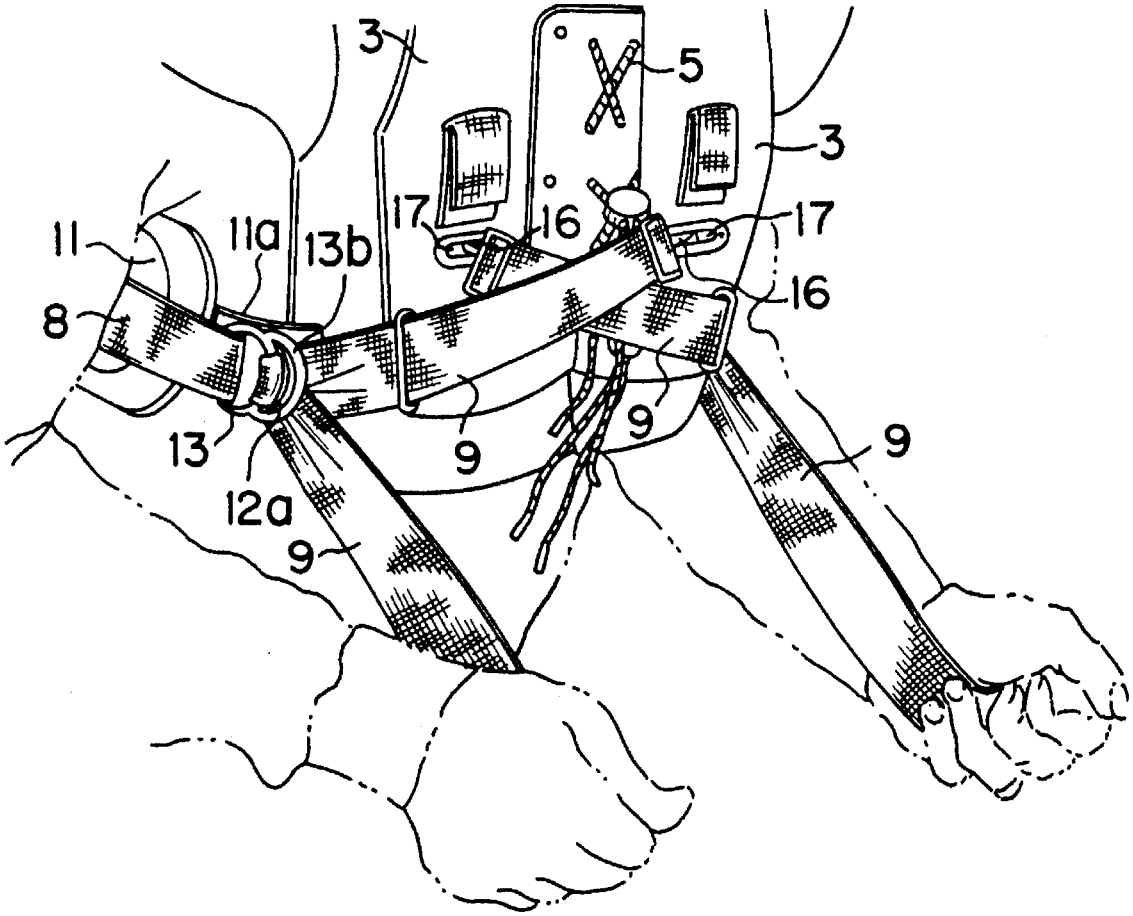
FIG. 5 is a perspective view of the underarm straps similar to FIG. 1 but showing the strap segments connected to the breast plates, being in a crossover relationship.

While FIG. 1 shows the tee buckles 16 inserted into the breast plate slots 17 on the same side of the shoulder pad as the respective strap segments 9, FIG. 5 illustrates another arrangement wherein the tee buckles 16 are inserted into slots 17 in breast plates 3 on opposite sides of the shoulder pad, so that the strap segments 9 extend over the breast plates 3 in cross-over relationship.

From the above description is will be readily apparent to those skilled in the art that the strap 6 of the present invention is an improvement over heretofore employed underarm straps for shoulder pads in that the use of non-elastic webbing prevents the spread of the breast plates 3 and back plates 4 upon impact on the arches 2 of the shoulder pad 1, to thereby minimize impact to the trapezius muscle and levator scapulae muscle of the player, and the firm fixation of the shoulder pad to the player's torso also reduces impact to the acromio clavicular joint. The two, in line strap segments 8 and 9 on each side of the shoulder pad 1, and associated clamping rings 12', 13 permit a quick, infinite adjustment of the effective length of the underarm straps 6, while the player employs major arm strength by pushing the strap segments 9 forwardly to tighten the underarm straps 6, and the loop portion 13*b* on the upper or outer ring 13 provides a convenient handle for rapid and easy release of the clamping rings 12' and 13.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

We claim:

1. Underarm straps in combination with shoulder pads, comprising a pair of arch portions terminating in the front by a pair of breast plates and in the rear by a pair of back plates, a pair of underarm straps extending under the arms of the user on each side of the shoulder pads and being connected at each end to the back plates and breast plates, respectively, each underarm strap including a pair of first and second strap segments of non-elastic strap material, said first strap segment having one end secured to a said back plate of the shoulder pad, said first strap segment having an other end, a pair of superimposed inner and outer clamping rings having rims being connected to said other end of said first strap segment, the second strap segment extending upwardly through both of said inner and outer clamping rings and then downwardly over the rim of said outer clamping ring and under the rim of said inner clamping ring, whereby the second strap segment is gripped between the rims of the clamping rings, connector means on one end portion of the second strap segment for connecting the second strap segment to a said breast plate, an other end portion of each second strap segment positioned to be grasped and pushed forwardly by the user to shorten the length of the underarm straps, to thereby tighten the shoulder pads on the user, a first component of a fastener provided on said first strap segment substantially intermediate the ends thereof, and a second component of a fastener provided on said other end portion of said second strap segment adapted to cooperate with said first fastener component, to thereby detachably interconnect said first and second strap segments, whereby after the shoulder pads are tightened on the user, said other end portions of the second straps are folded backward to cover the clamping rings and the first and second strap segments are interconnected.

2. The underarm straps according to claim 1, wherein the cooperating first and second fastener components comprise hook and loop fabrics.

3. The underarm straps according to claim 1, wherein a handle is connected to the outer ring of the superimposed clamping rings to facilitate the release of the second strap segment by manually pulling outwardly on the outer clamping ring, and said other end portion of said second strap in the folded backward position covers said handle.

4. The underarm straps according to claim 3, wherein the handle comprises a loop portion integral with and extending radially outwardly from the outer peripheral edge of the outer ring.

5. The underarm straps according to claim 3, in which said outer ring is in the form of a double D-ring, and the inner ring is in the form of a D-ring.

6. The underarm straps according to claim 3, in which said handle faces forwardly toward the breast plate.

7. The underarm straps according to claim 1, in which said pair of superimposed clamping rings are positioned adjacent the breast plate.

8. Underarm straps in combination with shoulder pads, comprising a pair of arch portions terminating in the front by a pair of breast plates and in the rear by a pair of back plates, a pair of underarm straps extending under the arms of the user on each side of the shoulder pads and being connected at each end to the back plates and breast plates, respectively, each underarm strap including a pair of first and second strap segments of non-elastic strap material, said first strap segment having one end secured to a said back plate of the shoulder pad, said first strap segment having an other end, a pair of superimposed inner and outer clamping rings having rims being connected to said other end of said first strap segment, the second strap segment extending upwardly through both of said inner and outer clamping rings and then downwardly over the rim of said outer clamping ring and under the rim of said inner clamping ring, whereby the second strap segment is gripped between the rims of the clamping rings, protective pad means connected to said first strap segment adjacent said other end and superimposed with said pair of clamping rings, connector means on one end portion of the second strap segment for connecting the second strap segment to a said breast plate, and an other end portion of each second strap segment positioned to be grasped and pushed forwardly by the user to shorten the length of the underarm straps, to thereby tighten the shoulder pads on the user.

9. The underarm straps according to claim 8, in which said protective pad means is connected to said other end of said first strap segment between said superimposed clamping rings and the user.

10. Underarm straps in combination with shoulder pads, comprising a pair of arch portions terminating in the front by a pair of breast plates and in the rear by a pair of back plates, a pair of underarm straps extending under the arms of the user on each side of the shoulder pads and being connected at each end to the back plates and breast plates, respectively, each underarm strap including a pair of first and second strap segments of non-elastic strap material, said first strap segment having one end secured to a said back plate of the shoulder pad, said first strap segment having an other end, a pair of superimposed inner and outer clamping rings having rims, a loop formed on said other end of said first strap segment and connecting said pair of superimposed clamping rings thereto, the second strap segment extending upwardly through both of said inner and outer clamping rings and then downwardly over the rim of said outer clamping ring and under the rim of said inner clamping ring, whereby the second strap segment is gripped between the rims of the clamping rings, a protective pad connected to said other end of said first strap segment and extending in superimposed position between said clamping rings and the user, connector means on one end portion of the second strap segment for connecting the second strap segment to a said breast plate, and an other end portion of each second strap segment positioned to be grasped and pushed forwardly by the user to shorten the length of the underarm straps, to thereby tighten the shoulder pads on the user.

11. The underarm straps according to claim 10, including stitching through said first strap segment forming said loop on said other end and simultaneously connecting said protective pad thereto.

12. The underarm straps according to claim 11, in which said protective pad extends between said loop and said user.

13. The underarm straps according to claim 10, in which said protective pad is superimposed with said loop and said pair of clamping rings.

14. A tightening strap assembly comprising, a pair of first and second strap segments of non-elastic strap material, said first strap segment having one end adapted to be connected to a first member, said first strap segment having an other end, a pair of superimposed inner and outer clamping rings having rims being connected to said other end of said first strap segment, the second strap segment extending upwardly through both of said inner and outer clamping rings and then downwardly over the rim of said outer clamping ring and under the rim of said inner clamping ring, whereby the second strap segment is gripped between the rims of the clamping rings, one end portion of the second strap segment adapted to be connected to a second member, an other end portion of said second strap segment positioned to be grasped and moved forwardly by the user to shorten the length of and to thereby tighten the strap assembly, a first component of a fastener provided on said first strap segment substantially intermediate the ends thereof, and a second component of a fastener provided on said other end portion of said second strap segment adapted to cooperate with said first fastener component, to thereby detachably interconnect said first and second strap segments, whereby after the strap assembly is tightened said other end portion of the second strap is folded backward to cover the clamping rings and the first and second strap segments are interconnected.

15. A tightening strap assembly according to claim 14, wherein the cooperating first and second fastener components comprise hook and loop fabrics.

16. A tightening strap assembly according to claim 14, wherein a handle is connected to the outer ring of the superimposed clamping rings to facilitate the release of the second strap segment by manually pulling outwardly on the outer clamping ring, and said other end portion of said second strap in the folded backward position covers said handle.

17. A tightening strap assembly according to claim 16, wherein the handle comprises a loop portion integral with and extending radially outwardly from the outer peripheral edge of said outer ring.

18. A tightening strap assembly according to claim 16, in which said outer ring is in the form of a double D-ring, and the inner ring is in the form of a D-ring.

19. A tightening strap assembly according to claim 16, in which said handle faces forwardly toward said one end portion of said second strap segment.

20. A tighting strap assembly comprising, a pair of first and second strap segments of non-elastic strap material, said first strap segment having one end adapted to be connected to a first member, said first strap segment having an other end, a pair of superimposed inner and outer clamping rings having rims being connected to said other end of said first strap segment, the second strap segment extending upwardly through both of said inner and outer clamping rings and then downwardly over the rim of said outer clamping ring and under the rim of said inner clamping ring, whereby the second strap segment is gripped between the rims of the clamping rings, protective pad means connected to said first strap segment adjacent said other end and superimposed with said pair of clamping rings, one end portion of the second strap segment adapted to be connected to a second member, and an other end portion of said second strap segment positioned to be grasped and moved forwardly by the user to shorten the length of and to thereby tighten the strap assembly.

21. A tightening strap assembly according to claim 20, in which said protective pad means is connected to said other end of said first strap segment inwardly of said superimposed clamping rings.

22. A tighting strap assembly comprising, a pair of first and second strap segments of non-elastic strap material, said first strap segment having one end adapted to be connected to a first member, said first strap segment having an other end, a pair of superimposed inner and outer clamping rings having rims, a loop formed on said other end of said first strap segment and connecting said pair of superimposed clamping rings thereto, the second strap segment extending upwardly through both of said inner and outer clamping rings and then downwardly over the rim of said outer clamping ring and under the rim of said inner clamping ring, whereby the second strap segment is gripped between the rims of the clamping rings, a protective pad connected to said other end of said first strap segment and extending in superimposed position with said clamping rings, one end portion of the second strap segment adapted to be connected to a second member, and an other end portion of said second strap segment positioned to be grasped and moved forwardly by the user to shorten the length of and to thereby tighten the strap assembly.

23. A tightening strap assembly according to claim 22, including stitching through said first strap segment forming said loop on said other end and simultaneously connecting said protective pad thereto.

24. A tightening strap assembly according to claim 23, in which said protective pad extends inwardly of said loop.

25. A tightening strap assembly according to claim 22, in which said protective pad is superimposed with said loop and said pair of clamping rings.

* * * * *